US009675992B2

(12) United States Patent
Kawaguchi et al.

(10) Patent No.: US 9,675,992 B2
(45) Date of Patent: Jun. 13, 2017

(54) SUBSTRATE PROCESSING APPARATUS, SUBSTRATE PROCESSING METHOD, AND COMPUTER-READABLE STORAGE MEDIUM STORING SUBSTRATE PROCESSING PROGRAM

(71) Applicant: Tokyo Electron Limited, Tokyo (JP)

(72) Inventors: Yoshihiro Kawaguchi, Koshi (JP); Satoshi Kaneko, Koshi (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 136 days.

(21) Appl. No.: 14/570,266

(22) Filed: Dec. 15, 2014

(65) Prior Publication Data

US 2015/0165471 A1 Jun. 18, 2015

(30) Foreign Application Priority Data

Dec. 16, 2013 (JP) ..... 2013-259017

(51) Int. Cl.

| | |
|---|---|
| ***B05C 11/10*** | (2006.01) |
| ***B05C 3/02*** | (2006.01) |
| ***B05C 3/00*** | (2006.01) |
| ***C23C 18/16*** | (2006.01) |

(52) U.S. Cl.

CPC ..... *B05C 11/1002* (2013.01); *B05C 3/005* (2013.01); *B05C 3/02* (2013.01); *C23C 18/168* (2013.01); *C23C 18/1619* (2013.01); *C23C 18/1632* (2013.01); *C23C 18/1675* (2013.01); *C23C 18/1669* (2013.01); *Y10T 137/0318* (2015.04); *Y10T 137/0329* (2015.04)

(58) Field of Classification Search

None

See application file for complete search history.

(56) References Cited

U.S. PATENT DOCUMENTS

| | | | | |
|---|---|---|---|---|
| 6,500,482 | B1 * | 12/2002 | Morcos | C23C 18/1617 427/438 |
| 2005/0163916 | A1 * | 7/2005 | Dubin | C23C 18/1632 427/58 |
| 2006/0042756 | A1 * | 3/2006 | Miyazaki | B08B 3/00 156/345.18 |

FOREIGN PATENT DOCUMENTS

JP 2013-010994 A 1/2013

* cited by examiner

*Primary Examiner* — Charles Capozzi
(74) *Attorney, Agent, or Firm* — Pearne & Gordon LLP

(57) ABSTRACT

A substrate processing apparatus includes one or more substrate processing units 11 to 18 each processing a substrate 3 with a processing fluid; processing fluid supply units 19 and 20 supplying the heated processing fluid to the substrate processing units 11 to 18; and a controller 21 controlling the processing fluid supply units 19 and 20. The processing fluid supply units 19 and 20 include a storage tank 35 storing the processing fluid; a heating heat exchanger 51 heating the processing fluid; and a supply path 52 supplying the processing fluid to the substrate processing units 11 to 18. The supply path 52 includes a bypass path 71 bypassing the heating heat exchanger 51 at an upstream of the substrate processing units 11 to 18. The processing fluid heated by the heating heat exchanger 51 and the processing fluid supplied from the bypass path 71 are mixed to be supplied.

9 Claims, 4 Drawing Sheets

SUBSTRATE PROCESSING APPARATUS, SUBSTRATE PROCESSING METHOD, AND COMPUTER-READABLE STORAGE MEDIUM STORING SUBSTRATE PROCESSING PROGRAM

CROSS-REFERENCE TO RELATED APPLICATION

This application claims the benefit of Japanese Patent Application No. 2013-259017 filed on Dec. 16, 2013, the entire disclosures of which are incorporated herein by reference.

TECHNICAL FIELD

The embodiments described herein pertain generally to a substrate processing apparatus and a substrate processing method of processing a substrate with a heated processing fluid, and, also, relate to a storage medium having stored thereon a substrate processing program.

BACKGROUND

Conventionally, when manufacturing semiconductor components, flat panel displays, or the like, various kinds of processes such as cleaning, etching and plating are performed on a substrate such as a semiconductor wafer or a liquid crystal substrate by using a substrate processing apparatus.

As an example, a substrate processing apparatus that performs a plating process on a circuit pattern formed on a surface of a substrate includes a substrate processing unit that processes the substrate with a processing fluid (plating liquid); and a processing fluid supply unit that supplies the processing fluid heated to a preset temperature to the substrate processing unit. The processing fluid supply unit connects a storage tank that stores therein the processing fluid of a room temperature and the substrate processing unit with a supply line. A heater is provided at a portion of the supply line.

In this conventional substrate processing apparatus, the processing fluid of the room temperature stored in the storage tank is supplied to the substrate processing unit after heated to the preset temperature by the heater, and the substrate is processed in the substrate processing unit by using the processing fluid of the preset temperature (see, for example Patent Document 1).

Patent Document 1: Japanese Patent Laid-open Publication No. 2013-010994

In the conventional substrate processing apparatus, however, when processing the substrate in the substrate processing unit, since the processing fluid is supplied to the substrate processing unit after heated to the preset temperature by the heater, it is difficult to promptly respond when a flow rate of the processing fluid used in the substrate processing unit is changed or when the processing fluid is supplied to the substrate processing unit after heated to the preset temperature depending on a flow rate of the processing fluid used in the substrate processing unit. In such cases, it is difficult to supply the processing fluid of the preset temperature to the substrate processing unit stably.

Further, in the conventional substrate processing apparatus, the processing fluid supply unit is connected to the substrate processing unit in one-to-one correspondence. Therefore, if the number of substrate processing units increases, a corresponding number of processing fluid supply units is required, resulting in scale-up of the substrate processing apparatus.

SUMMARY

In one example embodiment, a substrate processing apparatus includes one or more substrate processing units each configured to process a substrate with a processing fluid; a processing fluid supply unit configured to supply the heated processing fluid to the one or more substrate processing units; and a controller configured to control the processing fluid supply unit. Further, the processing fluid supply unit includes a storage tank configured to store the processing fluid therein; a heating heat exchanger configured to heat the processing fluid; and a supply path configured to supply the processing fluid to the one or more substrate processing units. Furthermore, the supply path is equipped with a bypass path which bypasses the heating heat exchanger at an upstream of the one or more substrate processing units, and the processing fluid heated by the heating heat exchanger and the processing fluid supplied from the bypass path are mixed in the supply path and the mixed processing fluid is supplied to the one or more substrate processing units.

The controller may control a flow rate of the processing fluid to be heated by the heating heat exchanger and a flow rate of the processing fluid to be supplied from the bypass path according to a flow rate of the processing fluid to be supplied to one or more substrate processing units, and may mix the processing fluid heated by the heating heat exchanger and the processing fluid supplied from the bypass path such that the mixed processing fluid reaches a preset temperature. Then, the controller may supply the mixed processing fluid of the preset temperature to the one or more substrate processing units.

The processing fluid supply unit may further include a first circulation path in which the heating heat exchanger, the supply path and a cooling heat exchanger configured to cool the processing fluid are connected with the storage tank in sequence, and the processing fluid stored in the storage tank may be circulated through the first circulation path.

The controller may stop heating by the heating heat exchanger when the supply of the processing fluid to the one or more substrate processing units is stopped.

A second circulation path configured to circulate the processing fluid stored in the storage tank without heating the processing fluid may be provided. Further, the controller may circulate the processing fluid through the first circulation path while the processing fluid is supplied to the one or more substrate processing units, whereas the controller may circulate the processing fluid in the second circulation path while the processing fluid is not supplied to the one or more substrate processing units.

In another example embodiment, a substrate processing method includes heating a processing fluid stored in a storage tank by a heating heat exchanger and supplying the heated processing fluid from a supply path to one or more substrate processing units; supplying the processing fluid stored in the storage tank to a portion of the supply path at an upstream of the one or more substrate processing units from a bypass path which bypasses the heating heat exchanger; and mixing the processing fluid heated by the heating heat exchanger and the processing fluid supplied from the bypass path and supplying the mixed processing fluid to the one or more substrate processing units.

The processing fluid heated by the heating heat exchanger and the processing fluid supplied from the bypass path may be mixed such that a temperature of the mixed processing fluid reaches a preset temperature by controlling a flow rate of the processing fluid to be heated by the heating heat exchanger and a flow rate of the processing fluid to be supplied from the bypass path according to a flow rate of the processing fluid to be supplied to the one or more substrate processing units. Further, the mixed processing fluid of the preset temperature may be supplied to the one or more substrate processing units.

The processing fluid stored in the storage tank may be circulated through a first circulation path in which the heating heat exchanger, the supply path and a cooling heat exchanger configured to cool the processing fluid are connected with the storage tank in sequence.

Heating by the heating heat exchanger may be stopped while the processing fluid is not supplied to the one or more substrate processing units.

The processing fluid stored in the storage tank may be circulated through a second circulation path without being heated. Further, the processing fluid may be circulated through the first circulation path while the processing fluid is supplied to the one or more substrate processing units, whereas the processing fluid may be circulated through the second circulation path while the processing fluid is not supplied to the one or more substrate processing units.

In still another example embodiment, a computer-readable storage medium has stored thereon computer-executable instructions that, in response to execution, cause a substrate processing apparatus to perform a substrate processing program of processing a substrate. The substrate processing apparatus includes one or more substrate processing units each configured to process the substrate with a processing fluid; a processing fluid supply unit configured to supply the heated processing fluid to the one or more substrate processing units; and a controller configured to control the processing fluid supply unit. Further, the substrate processing program includes heating the processing fluid stored in a storage tank by a heating heat exchanger and supplying the heated processing fluid from a supply path to one or more substrate processing units; supplying the processing fluid stored in the storage tank to a portion of the supply path at an upstream of the one or more substrate processing units from a bypass path which bypasses the heating heat exchanger; and mixing the processing fluid heated by the heating heat exchanger and the processing fluid supplied from the bypass path and supplying the mixed processing fluid to the one or more substrate processing units.

According to the example embodiments, the processing fluid heated to the preset temperature can be stably supplied to the one or more substrate processing units simultaneously. Thus, substrates can be processed in the substrate processing units effectively.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1:
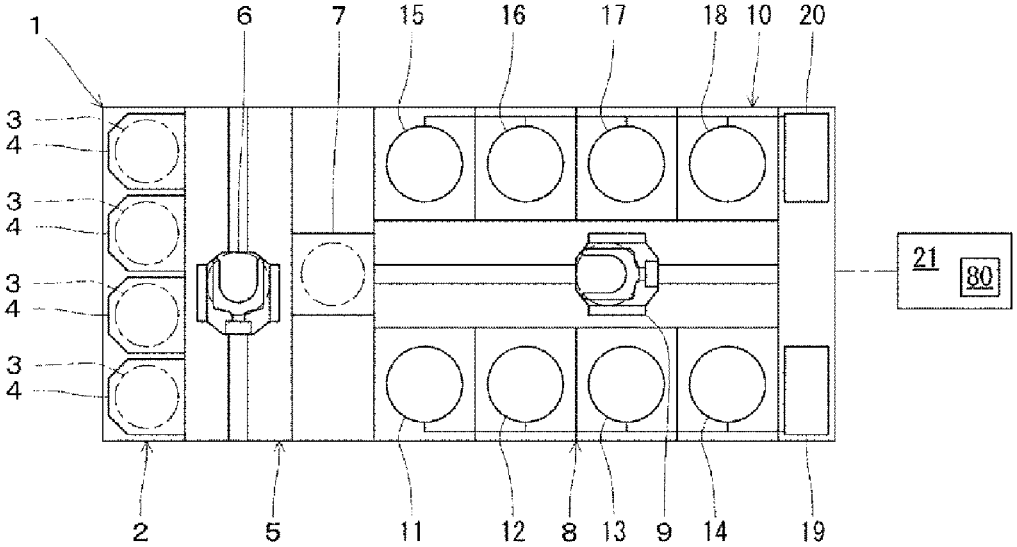
FIG. 1 is a plane view illustrating a substrate processing apparatus.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current example embodiment. Still, the example embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

Hereinafter, a substrate processing apparatus, a substrate processing method and a substrate processing program in accordance with an example embodiment will be described in detail with reference to the accompanying drawings, which form a part of the description.

As depicted in FIG. 1, a substrate processing apparatus 1 includes a loading/unloading block 2 provided at a front end thereof. Carriers 4, each of which accommodates therein a multiple number (for example, 25 sheets) of substrates 3 (here, semiconductor wafers), are loaded into or unloaded from the loading/unloading block 2. In the loading/unloading block 2, the carriers 4 are mounted side by side in a left-and-right direction.

Further, the substrate processing apparatus 1 includes a transfer block 5 provided at the rear side of the loading/unloading block 2. The transfer block 5 incorporates a substrate transfer device 6 at a front side thereof and a substrate transit table 7 at a rear side thereof. In this transfer block 5, substrates 3 are transferred between one of the carriers 4 mounted in the loading/unloading block 2 and the substrate transit table 7 by using the substrate transfer device 6.

Provided at the rear side of the transfer block 5 within the substrate processing apparatus 1 is a processing block 8. A substrate transfer device 9 extended in a forward-backward direction is provided at a center of the processing block 8, and a plating apparatus 10 configured to perform a plating process on the substrate 3 are arranged at the left and right sides of the substrate transfer device 9. In this processing block 8, the substrate 3 is transferred between the substrate transit table 7 and the plating apparatus 10 by using the substrate transfer device 9, and a liquid process is performed on the substrates 3 by using the plating apparatus 10.

The plating apparatus 10 includes first to fourth substrate processing units 11 to 14 arranged in a forward-and-backward direction at one side of the substrate transfer device 9; and fifth to eighth substrate processing units 15 to 18 arranged in the forward-and-backward direction at the other side of the substrate transfer device 9. In the plating apparatus 10, a first processing fluid supply unit 19 is connected to the first to fourth substrate processing units 11 to 14, and a second processing fluid supply unit 20 is connected to the fifth to eighth substrate processing units 15 to 18. The first to fourth substrate processing units 11 to 14 are configured to process substrates 3 by using a processing fluid heated to a preset temperature which is supplied from the first processing fluid supply unit 19. The fifth to eighth substrate processing units 15 to 18 are configured to process substrates 3 by using the processing fluid heated to a preset temperature which is supplied from the second processing fluid supply unit 20. The first to eighth substrate processing units 11 to 18, the first and second processing fluid supply units 19 and 20, and the other individual components of the substrate processing apparatus 1 are controlled by a controller 21.

The first to eighth substrate processing units 11 to 18 have the same configuration, and the first and second processing fluid supply units 19 and 20 have the same configuration. Thus, in the following description, configurations of the first substrate processing unit 11 and the first processing fluid supply unit 19 will only be elaborated.

Figure 2:
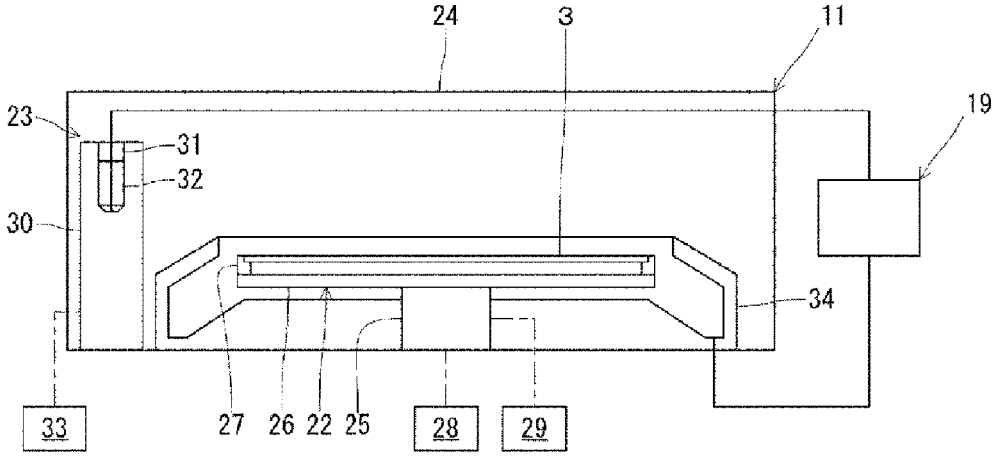
FIG. 2 is a side view illustrating a substrate processing unit.

The first substrate processing unit 11 includes, as illustrated in FIG. 2, a substrate rotating unit 22 configured to rotate a substrate 3 while holding the substrate 3 thereon; and a processing fluid discharging unit 23 configured to discharge a processing fluid (plating liquid) toward the substrate 3.

The substrate rotating unit 22 includes a vertically elongated rotation shaft 25 which is rotatably disposed at a substantially central portion of a substrate processing chamber 24. A circular plate-shaped turntable 26 is horizontally mounted on an upper end of the rotation shaft 25. A multiple number of substrate holders 27 are arranged at the edge portion of the turntable 26 at a regular interval along the circumference of the turntable 26.

Further, the substrate rotating unit 22 also includes a substrate rotating device 28 and a substrate elevating device 29 that are connected to the rotation shaft 25. Rotation of the substrate rotating device 28 and vertical movement of the substrate elevating device 29 are controlled by the control unit 21.

The substrate rotating unit 22 is configured to hold the substrate 3 thereon horizontally with the substrate holders 27 of the turntable 26. Further, the substrate rotating unit 22 is configured to rotate the substrate 3 held on the turntable 26 through the substrate rotating device 28 and move the turntable 26 and the substrate 3 up and down through the substrate elevating device 29.

The processing fluid discharging unit 23 includes a vertically extended rotation shaft 30 which is rotatably disposed at the left region of the substrate processing chamber 24. A horizontally extended arm 31 is provided on an upper end of the rotation shat 30. A nozzle 32 is provided to a lower portion of a leading end of the arm 31, facing vertically downwards. The first processing fluid supply unit 19 is connected to the nozzle 32.

The processing fluid discharging unit 23 also includes a nozzle moving device 33 connected to the rotation shaft 30. The nozzle moving device 33 is controlled by the controller 21.

The processing fluid discharging unit 23 is capable of moving the nozzle 32 between a central portion of the substrate 3 and a left-side external position outside the substrate 3 through the nozzle moving device 33, and, also, capable of discharging the processing fluid of a preset temperature, which is supplied from the first processing fluid supply unit 19, toward a surface (top surface) of the substrate 3 from the nozzle 32.

Further, a circular ring-shaped collecting cup 34 is also provided within the substrate processing chamber 24 to surround the turntable 26. The collecting cup 34 has an opening at an upper end thereof, and the opening has a size larger than the turntable 26. Further, the first processing fluid supply unit 19 is connected to a lower end portion of the collecting cup 34. The processing fluid supplied onto the substrate 3 is collected by the collecting cup 34 and then drained out into the first processing fluid supply unit 19.

Figure 3:
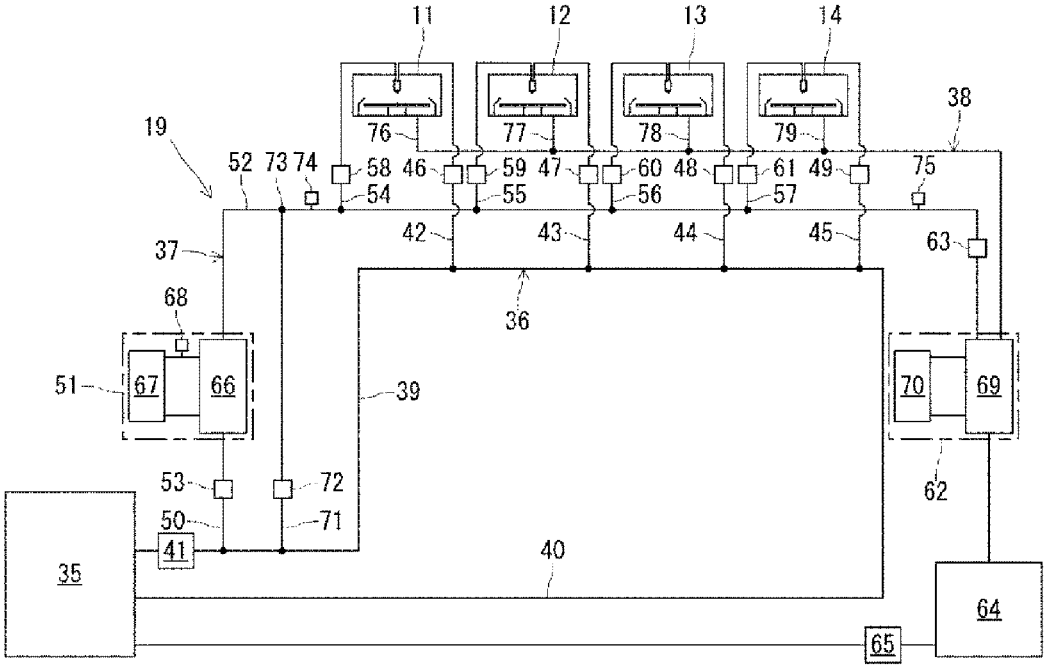
FIG. 3 is a block diagram illustrating a processing fluid supply unit.

In the first processing fluid supply unit 19, as illustrated in FIG. 3, a storage tank 35, which stores therein the processing fluid at a temperature where the processing fluid is not degraded (i.e., a temperature at which precipitation of metal ions through self-reaction of the plating liquid does not progress: for example, a room temperature), is connected with a first circulation path 37, a second circulation path 36, and a collecting path 38. The first circulation path 37 is configured to circulate the processing fluid of a first temperature. The second circulation path 36 is configured to circulate the processing fluid of a second temperature lower than the first temperature. The collecting path 38 is configured to circulate the processing fluids supplied to the substrates 3 from the first to fourth substrate processing units 11 to 14. The second circulation path 36 may circulate therein the processing fluid at the second temperature lower than the first temperature. That is, the processing fluid stored in the storage tank 35 may be circulated in the second circulation path 36 without being heated or after being heated to the second temperature lower than the first temperature.

The second circulation path 36 includes a forwarding circulation path 39 and a returning circulation path 40 connected to the storage tank 35. Further, a circulation pump 41 is provided at an outlet of the storage tank 35. Nozzles 32 of the first to fourth substrate processing units 11 to 14 are connected to the forwarding circulation path 39 via branch lines 42 to 45, respectively. Flow rate controllers 46 to 49 are connected to portions of the branch lines 42 to 45, respectively. The circulation pump 41 and the flow rate controllers 46 to 49 are controlled by the controller 21.

The second circulation path 36 circulates the processing fluid of the room temperature stored in the storage tank 35 without heating the processing fluid, and supplies the processing fluid of the room temperature to the first to fourth processing units 11 to 14 when necessary.

The first circulation path 37 includes a branch path 50 branched from the forwarding circulation path 39 of the second circulation path 36; a heating heat exchanger 51 connected to the branch path 50; and a supply path 52 connected to the heating heat exchanger 51. A flow rate controller 53 is connected to a portion of the branch path 50. The nozzles 32 of the first to fourth substrate processing units 11 to 14 are connected to the supply path 52 via branch lines 54 to 57, respectively, and flow rate controllers 58 to 61 are connected to portions of the branch lines 54 to 57, respectively. The heating heat exchanger 51 and the flow rate controllers 53 and 58 to 61 are controlled by the controller 21.

Further, the first circulation path 37 is also equipped with a cooling heat exchanger 62 which is connected to the supply path 52 via a flow rate controller 63. The cooling heat exchanger 62 and the storage tank 35 are connected via a buffer tank 64 and a circulation pump 65. The cooling heat exchanger 62, the flow rate controller 63 and the circulation pump 65 are controlled by the controller 21.

Here, the heating heat exchanger 51 is configured to heat the processing fluid flowing within a vessel 66 by a heating fluid supplied from a heating fluid supply source 67. The heating fluid supply source 67 is controlled by the controller 21. A temperature of the heating fluid supplied from the heating fluid supply source 67 is detected by a temperature sensor 68. Further, the cooling heat exchanger 62 is configured to cool the processing fluid flowing within a vessel 69 by a cooling fluid supplied from a cooling fluid supply source 70. The cooling fluid supply source 70 is controlled by the controller 21.

Further, the first circulation path 37 also has a bypass path 71 branched from the forwarding circulation path 39 of the second circulation path 36, and the bypass path 71 is connected to the supply path 52 at the upstream of the first to fourth substrate processing units 11 to 14. A flow rate controller 72 is connected to a portion of the bypass path 71. A temperature sensor 74 is also provided at the supply path 52 to be located at the downstream of a joint portion 73 between the supply path 52 and the bypass path 71 and upstream of the first to fourth substrate processing units 11 to 14. A temperature sensor 75 is also provided on the supply path 52 at the downstream of the first to fourth substrate processing units 11 to 14.

Further, the first circulation path 37 is configured to, after heating the room-temperature processing fluid stored in the storage tank 35 to a preset temperature, cool the heated processing fluid to a temperature at which the processing fluid is not degraded (i.e., a temperature at which precipitation of metal ions through self-reaction of the plating liquid does not process: for example, the room temperature) and circulate the cooled processing fluid. The first circulation path 37 also supplies the processing fluid of a preset temperature to the first to fourth substrate processing units 11 to 14 when necessary.

The collecting path 38 connects the collecting cups 34 of the first to fourth substrate processing units 11 to 14 with the cooling heat exchanger 62 via branch lines 76 to 79, respectively.

The collecting path 38 collects the processing fluids of the room temperature or the preset temperature supplied to the first to fourth substrate processing units 11 to 14 from the second circulation path 36 or the first circulation path 37 into the cooling heat exchanger 62.

As for the supply of the processing fluid from the first processing fluid supply unit 19 to the first to fourth substrate processing units 11 to 14, the processing fluid may be supplied to only one of the first to fourth substrate processing units 11 to 14 at a flow rate in a certain range or may be supplied to all of the first to fourth substrate processing units 11 to 14 concurrently at the same flow rate or different flow rates depending on processing conditions of the substrates 3 within the first to fourth substrate processing units 11 to 14.

The substrate processing apparatus 1 is configured as described above and is controlled by the controller 21 (computer) to perform a preset process on the substrate 3 according to various kinds of programs recorded in a storage medium 80 installed in the controller 21). Here, the storage medium 80 stores thereon various kinds of setup data or programs and may be implemented by a memory such as a ROM or a RAM, or a disk-type storage medium such as a hard disk, a CD-ROM, DVD-ROM or a flexible disk, as commonly known in the art.

When processing the substrates 3 with the processing fluid heated to the preset temperature, the substrate processing apparatus 1 performs a process on the substrate 3 according to a substrate processing program (see FIG. 4) stored in a storage medium 80, as will be described below. The following description is provided for the case where the substrates 3 are processed in the first to fourth substrate processing units 11 to 14.

Figure 4:
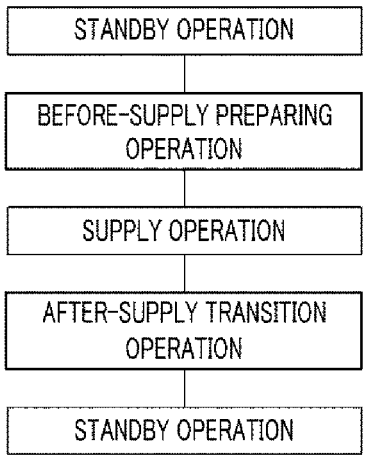
FIG. 4 is a flowchart for describing a substrate processing program.
Figure 5:
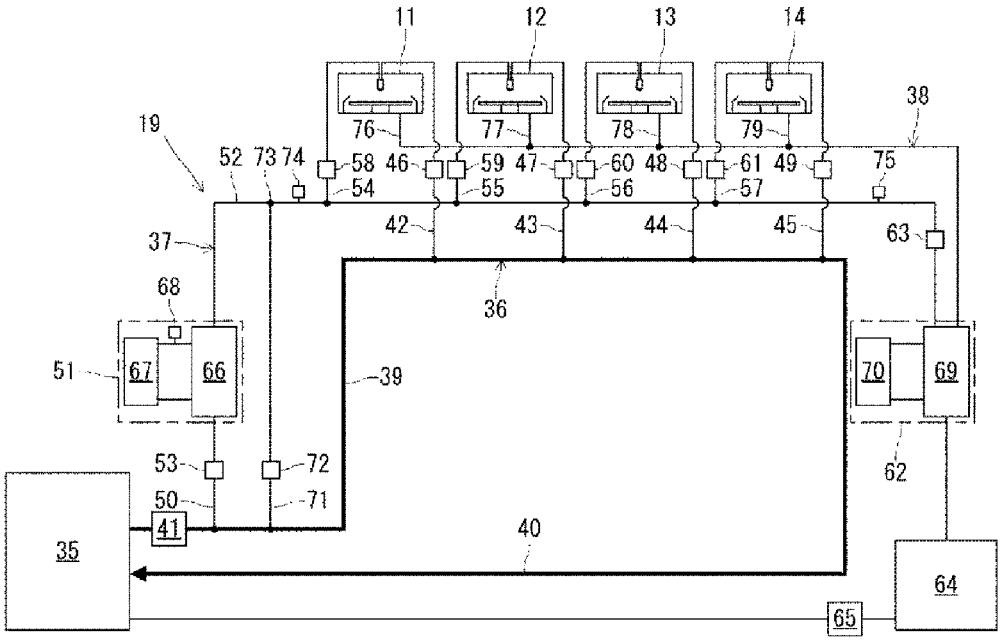
FIG. 5 is a diagram illustrating an operation of the processing fluid supply unit (standby operation process)

First, as depicted in FIG. 4 and FIG. 5, the substrate processing apparatus 1 performs a standby operation process in which the processing fluid stored in the storage tank 35 is circulated without heated before the substrates 3 are processed in the first to fourth substrate processing units 11 to 14 (standby operation process).

In this standby operation process, the processing fluid of the room temperature stored in the storage tank 35 is circulated through the second circulation path 36 without heated. To elaborate, by driving the circulation pump 41, the processing fluid is circulated from the storage tank 35 through the circulation pump 41, the forwarding circulation path 39 and the returning circulation path 40 consecutively in sequence, and then, returned back into the storage tank 35.

Figure 6:
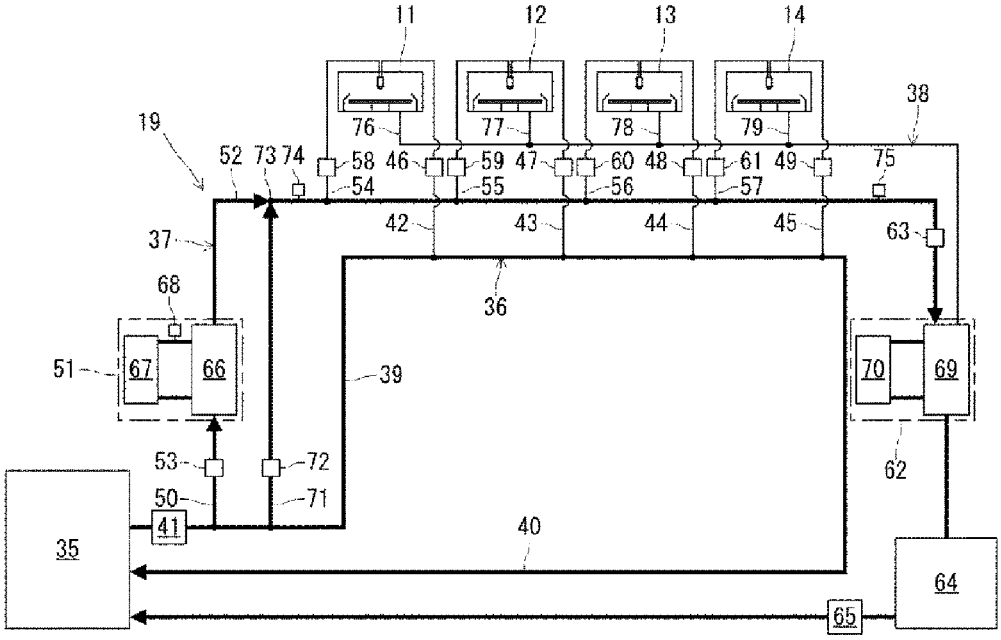
FIG. 6 is a diagram illustrating an operation of the processing fluid supply unit (before-supply preparing operation process)

Thereafter, as depicted in FIG. 4 and FIG. 6, when the substrates 3 are supposed to be processed in the first to fourth substrate processing units 11 to 14, the substrate processing apparatus 1 performs, prior to supplying the processing fluid to the first to fourth processing units 11 to 14, a before-supply preparing operation of heating and circulating the processing fluid stored in the storage tank 35 to supply the heated processing fluid of a preset temperature to the first to fourth substrate processing units 11 to 14 at a preset flow rate (before-supply preparing operation process).

In this before-supply preparing operation process, the processing fluid of the room temperature stored in the storage tank 35 is circulated while being heated through the first circulation path 37 until the temperature and the flow rate of the processing fluid reach preset values. To elaborate, by driving the circulation pump 65 of the first circulation path 37, the processing fluid is circulated from the storage tank 35 through the forwarding circulation path 39, the branch path 50, the heating heat exchanger 51 and the bypass path 71, the supply path 52, the cooling heat exchanger 62, the buffer tank 64 and the circulation pump 65 consecutively in sequence, and then, returned back into the storage tank 35. At this time, by driving the heating heat exchanger 51, the heating fluid is supplied into the vessel 66 from the heating fluid supply source 67, and the processing fluid is heated within the vessel 66 and supplied to the joint portion 73 of the supply path 52. Not only the processing fluid heated by the heating heat exchanger 51 is supplied to the joint portion 73, but the fluid of the room temperature is also supplied to this joint portion 73 through the bypass path 71. Accordingly, the heated processing fluid and the processing fluid of the room temperature are mixed at the joint portion 73 and flown through the supply path 52 at a temperature higher than the room temperature. This processing fluid is later cooled to the room temperature by the cooling heat exchanger 62 and then returned back into the storage tank 35. In this before-supply preparing operation process, the processing fluid is circulated through the second circulation path 36.

This before-supply preparing operation process is conducted until a temperature and a flow rate of the processing fluid flowing in the supply path 52 reach the preset temperature and the preset flow rate, respectively, to be stabilized.

At this time, the substrate processing apparatus 1 controls the flow rate of the processing fluid circulated through the first circulation path 37 depending on a flow rate of the processing fluid to be supplied to the first to fourth substrate processing units 11 to 14.

By way of example, as shown in Table 1, in case that the processing fluid is supposed to be supplied to all of the first to fourth substrate processing units 11 to 14, the flow rate of the processing fluid becomes maximum, and a total amount of 42 L/min of processing fluid (i.e., heating flow rate of the processing fluid heated by the heating heat exchanger 51), which is the sum of a usage flow rate of 40 L/min and an additional flow rate of 2 L/min, is circulated in the first circulation path 37. When the flow rate of the processing fluid is the maximum, the heating heat exchanger 51 is set to heat the total flow rate of processing fluid to the preset temperature. Thus, when the flow rate of the processing fluid is the maximum, a temperature control flow rate of the processing fluid, which is flown to the joint portion 73 of the supply path 52 through the bypass path 71 to perform the temperature control, is set to be zero (0). Here, each of the first to fourth substrate processing units 11 to 14 uses the processing fluid of a preset flow rate of 10 L/min, and the total amount of 40 L/min serves as the usage flow rate, which is actually used in the first to fourth substrate processing units 11 to 14 altogether. Further, the reason why the additional flow rate is added to the flow rate of the processing fluid is to supply the processing fluid into each of the branch lines 54 to 57 from the supply path 52 smoothly and accurately. A flow rate of the processing fluid used in each of the first to fourth substrate processing units 11 to 14 may not be maintained constant but varied.

TABLE 1

| Flow rate of processing fluid (L/min) | | | | | |
|---|---|---|---|---|---|
| Number of substrate processing units | | 1 | 2 | 3 | 4 |
| Heating flow rate | Usage flow rate | 10 | 20 | 30 | 40 |
| | Additional flow rate | 2 | 2 | 2 | 2 |
| Temperature control flow rate | | 8 | 4 | 2 | 0 |
| Total flow rate | | 20 | 26 | 34 | 42 |
| (Surplus flow rate) | | (10) | (6) | (4) | (2) |

In the substrate processing apparatus 1, the heating heat exchanger 51 is set to heat the total flow rate of processing fluid to the preset temperature when the flow rate of the processing fluid circulated in the first circulation path 37 is the maximum. Even if the flow rate of the processing fluid circulated in the first circulation path 37 decreases, the heating heat exchanger 51 is driven in the same operational status. Accordingly, the heating heat exchanger 51 can be controlled easily, and an inexpensive heat exchanger can be used as the heating heat exchanger 51.

Furthermore, since the heating heat exchanger 51 is set to heat the total flow rate of the processing fluid to the preset temperature when the flow rate of the processing fluid circulated in the first circulation path 37 is the maximum, the temperature control flow rate, i.e., the flow rate of the processing fluid of the room temperature supplied to the joint portion 73 through the bypass path 71 can be minimized (here, zero). As a result, the total flow rate of the processing fluid flowing in the cooling heat exchanger 62 or the circulation pump 65 is decreased, so that a load on the cooling heat exchanger 62 or the circulation pump 65 can be reduced and the operating time thereof can be lengthened.

As stated above, in case that the heating heat exchanger 51 is set to heat the processing fluid to the preset temperature when the flow rate of the processing fluid circulated in the first circulation path 37 is the maximum, the processing fluid may be excessively overheated by the heating heat exchanger 51 if the flow rate of the processing fluid heated by the heating heat exchanger 51 decreases due to a decrease of the flow rate of the processing fluid circulated in the first circulation path 37.

Thus, in the substrate processing apparatus 1, in case of supplying the processing fluid to any one to three of the first to fourth substrate processing units 11 to 14, the processing fluid is flown at a usage flow rate according to the number of the substrate processing units to which the processing fluid is to be supplied, and a temperature control flow rate is determined based on this usage flow rate, as depicted in Table 1. To elaborate, in case of supplying the processing fluid to all of the first to fourth substrate processing units 11 to 14, the usage flow rate is 40 L/min, the additional flow rate is 2 L/min, and the temperature control flow rate is 0 L/min. Further, in case of supplying the processing fluid to any three of the first to fourth substrate processing units 11 to 14, the usage flow rate is 30 L/min, the additional flow rate is 2 L/min, and the temperature control flow rate is 2 L/min. In this case, the processing fluid in a total amount of 32 L/min, as the heating flow rate which is the sum of the usage flow rate and the additional flow rate, is heated by the heating heat exchanger 51, and by mixing the processing fluid of the temperature control flow rate of 2 L/min to this heated processing fluid, the processing fluid is set to have the preset temperature. Likewise, in case of supplying the processing fluid to any two of the first to fourth substrate processing units 11 to 14, the usage flow rate is 20 L/min, the additional flow rate is 2 L/min, and the temperature control flow rate is 4 L/min. In this case, the processing fluid in a total amount of 22 L/min, as the heating flow rate which is the sum of the usage flow rate and the additional flow rate, is heated by the heating heat exchanger 51, and by mixing the processing fluid of the temperature control flow rate of 4 L/min to this heated processing fluid, the processing fluid is set to have the preset temperature. Furthermore, in case of supplying the processing fluid to any one of the first to fourth substrate processing units 11 to 14, the usage flow rate is 10 L/min, the additional flow rate is 2 L/min, and the temperature control flow rate is 8 L/min. In this case, the processing fluid in a total amount of 12 L/min, as the heating flow rate which is the sum of the usage flow rate and the additional flow rate, is heated by the heating heat exchanger 51, and by mixing the processing fluid of the temperature control flow rate of 8 L/min to this heated processing fluid, the processing fluid is set to have the preset temperature. The temperature control flow rates are previously calculated according to the heating flow rates in order to set the processing fluid of the total flow rates to have the preset temperature.

Whether the temperature of the processing fluid has reached the preset temperature or not is determined by measuring the temperature of the processing fluid with the temperature sensor 74 provided at the downstream of the joint portion 73 of the supply path 52 and the upstream of the first to fourth substrate processing units 11 to 14. Further, a temperature sensor 75 is also provided on the supply path 52 at the downstream of the first to fourth substrate processing units 11 to 14. Thus, whether the processing fluid has reached the preset temperature may be determined based on the average of the temperatures measured by the temperature sensors 74 and 75 at the upstream and downstream of the first to fourth substrate processing unit 11 to 14, respectively. Further, it may be also possible to calculate a temperature of the processing fluid corresponding to the temperature of the heating fluid measured by the temperature sensor 68 provided at the heating heat exchanger 51. When the temperature of the processing fluid is different from the preset temperature, the temperature control flow rate of the processing fluid may be minutely adjusted based on the temperature of the processing fluid.

Figure 7:
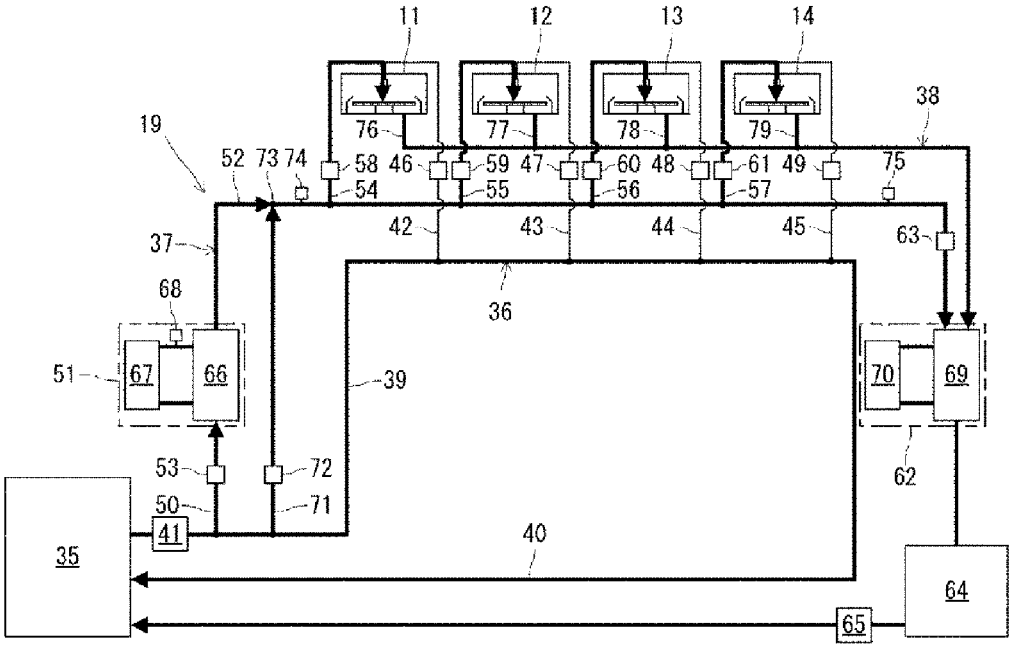
FIG. 7 is a diagram illustrating an operation of the processing fluid supply unit (supply operation process)

After the processing fluid flowing in the supply path 52 is stabilized at the preset flow rate and the preset temperature through the above-described before-supply preparing operation process, the substrate processing apparatus 1 performs a supply operation process of supplying the processing fluid circulated in the first circulation path 37 to the first to fourth substrate processing units 11 to 14 (supply operation process), as depicted in FIG. 4 and FIG. 7. During this supply operation process, substrates 3 are processed in the first to fourth substrate processing units 11 to 14 by using the processing fluid of the preset temperature supplied from the first processing fluid supply unit 19.

In this supply operation process, while circulating the same amount of processing fluid as that circulated in the before-supply preparing operation process through the first circulation path 37, the processing fluid is supplied to the first to fourth substrate processing units 11 to 14 from the supply path 52 via the branch lines 54 to 57, respectively, and the processing fluids used in the first to fourth substrate processing units 11 to 14 are collected.

For example, as shown in Table 1, in case of supplying the processing fluid to all of the first to fourth substrate processing units 11 to 14, the processing fluid is circulated at a total flow rate of 42 L/min as the sum of the usage flow rate of 40 L/min, the additional flow rate of 2 L/min and the temperature control flow rate of 0 L/min. Among this total flow rate of the processing fluid, the processing fluid of the usage flow rate of 40 L/min is supplied to the first to fourth substrate processing units 11 to 14. This processing fluid of the above usage flow rate is later collected from the first to fourth substrate processing units 11 to 14 to be flown into the cooling heat exchanger 62 from the collection path 38 and stored in the storage tank 35 after cooled to the room temperature by the cooling heat exchanger 62. Meanwhile, the processing fluid of the surplus flow rate of 2 L/min, which is not supplied to the first to fourth substrate processing units 11 to 14, is flown to the cooling heat exchanger 62 from the supply path 52 and stored in the storage tank 35 after cooled to the room temperature by the cooling heat exchanger 62. Likewise, in case of supplying the processing fluid to any one to three of the first to fourth substrate processing units 11 to 14, the processing fluid of the usage flow rate of 10 L/min to 30 L/min in the processing fluid of the total flow rate is supplied to any one to three of the first to fourth substrate processing units 11 to 14 and collected later. Meanwhile, the processing fluid of the surplus flow rate of 4 L/min to 10 L/min is collected without supplied to the first to fourth substrate processing units 11 to 14. Here, by varying the temperature control flow rate of the processing fluid depending on the usage flow rate of the processing fluid (i.e., heating flow rate) while maintaining the additional flow rate constant, the surplus flow rate increases as the total flow rate decreases. Accordingly, even if the flow rate of the processing fluid concurrently used in the first to fourth substrate processing units 11 to 14 varies, it is still possible to supply the processing fluid of the preset flow rate stably. Further, in case that the temperature of the processing fluid is changed from the preset temperature during the supply operation process, the temperature control flow rate of the processing fluid may be minutely adjusted based on the temperature of the processing fluid.

In this supply operation process, as in the above-described before-supply preparing operation process, the flow rate of the processing fluid to be circulated in the first circulation path 37 is adjusted based on the flow rate of the processing fluid to be supplied to the first to fourth substrate processing units 11 to 14. Accordingly, the flow rate of the processing fluid circulated in the first circulation path 37 can be minimized, so that degradation of the processing fluid as a result of heating and cooling in the first circulation path 37 can be suppressed.

Figure 8:
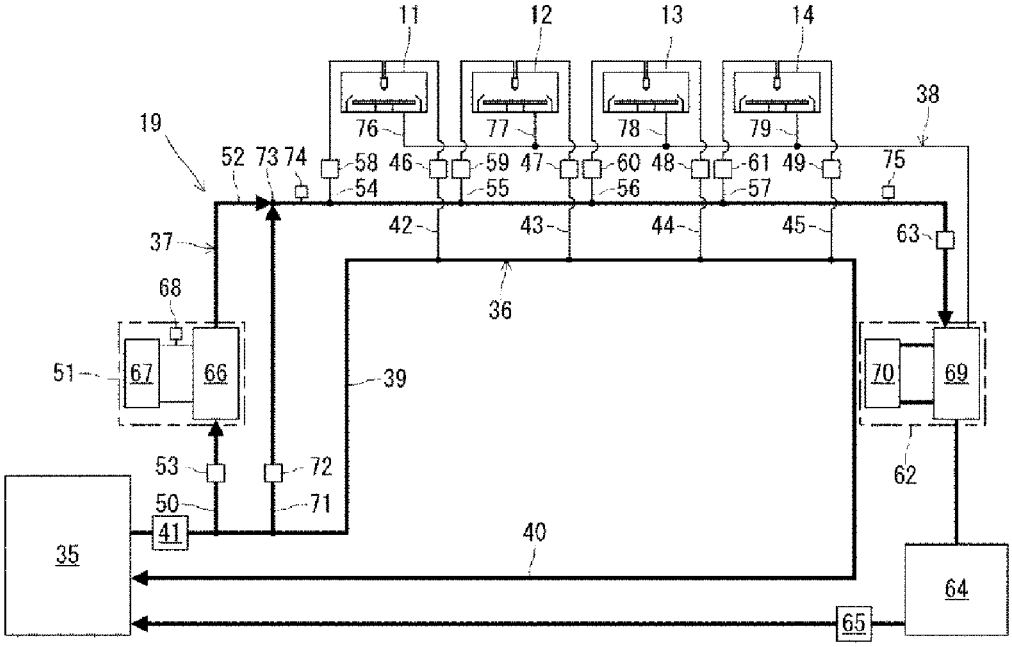
FIG. 8 is a diagram illustrating an operation of the processing fluid supply unit (after-supply transition operation process).

When stopping the supply operation process, the substrate processing apparatus 1 may promptly switch to the standby operation process. If, however, the supply operation process is switched to the standby operation process directly, the heated processing fluid may remain in the first circulation path 37 and may be thermally degraded. In view of this problem, when stopping the supply operation process, the substrate processing apparatus 1 performs the after-supply transition operation of circulating the processing fluid in the first circulation path 37 while stopping the heating of the processing fluid by the heating heat exchanger 51 (after-supply transition operation process), and then performs a standby operation of circulating the processing fluid in the second circulation path 36 (standby operation process), as shown in FIG. 4 and FIG. 8.

In the after-supply transition operation process, the processing fluid of the room temperature stored in the storage tank 35 is circulated through the first circulation path 37 without heated. To elaborate, by driving the circulation pump 65 of the first circulation path 37, the processing fluid is circulated from the storage tank 35 through the forwarding circulation path 39, the branch path 50, the heating heat exchanger 51 and the bypass path 71, the supply path 52, the cooling heat exchanger 62, the buffer tank 64 and the circulation pump 65 consecutively in sequence, and then, returned back into the storage tank 35. At this time, the operation of the heating heat exchanger 51 is stopped. The processing fluid is heated by residual heat while passing through the vessel 66 of the heating heat exchanger 51. Since, however, the operation of the heating heat exchanger 51 is stopped, the temperature of the vessel 66 slowly decreases to the room temperature, so that the temperature of the processing fluid circulated in the first circulation path 37 also reaches the room temperature. Here, it may be also possible to cool the vessel 66 of the heating heat exchanger 51 forcibly by supplying a cooling fluid thereto.

This after-supply transition operation process is performed until the temperature of the processing fluid flowing in the supply path 52 reaches the room temperature to be stabilized.

Thereafter, the substrate processing apparatus 1 performs the standby operation of circulating the processing fluid stored in the storage tank 35 without heating the processing fluid (standby operation process), as shown in FIG. 4 and FIG. 5. As stated above, by performing the after-supply transition operation process before switching from the supply operation process to the standby operation process, the heated processing fluid can be suppressed from remaining in the first circulation path 37 and from being thermally degraded.

As stated above, the substrate processing apparatus 1 includes the storage tank 35 configured to store the processing fluid therein, the heating heat exchanger 51 configured to heat the processing fluid, and the supply path 52 for supplying the processing fluid to one or more substrate processing units (first to eighth substrate processing units 11 to 18). The supply path 52 is equipped with the bypass path 71 which bypasses the heating heat exchanger 51 at the upstream of the substrate processing units (first to eighth substrate processing units 11 to 18). The processing fluid heated by the heating heat exchanger 51 is mixed with the processing fluid supplied from the bypass path 71. Then, by supplying this mixed processing fluid to the substrate processing units (first to eighth substrate processing units 11 to 18), the substrates 3 are processed in the substrate processing units (first to eighth substrate processing units 11 to 18).

In the substrate processing apparatus 1 having the above-described configuration, even if the flow rate of the processing fluid used in the substrate processing units (first to eighth substrate processing units 11 to 18) varies or even if the number of the substrate processing units (first to eighth substrate processing units 11 to 18) using the processing fluid simultaneously is changed, it is still possible to stably supply the processing fluid of the preset temperature to the substrate processing units (first to eighth substrate processing units 11 to 18) from the supply path 52 of the first circulation path 37, so that the substrates 3 can be processed effectively. Further, even if the number of the substrate processing units (first to eighth substrate processing units 11 to 18) is increased, an additional substrate processing fluid supply unit is not required. Thus, enlargement of the substrate processing apparatus 1 can be suppressed.

Moreover, the above-described substrate processing apparatus 1 is configured to perform a plating process by using a plating liquid as the processing fluid. However, the example embodiment is not limited to the plating process and may be applied to various kinds of substrate processing apparatuses configured to perform various kinds of processes on substrates 3 by using a processing fluid such as a cleaning liquid, a rinse liquid or an etching liquid heated to a preset temperature.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

We claim:

1. A substrate processing apparatus, comprising:

one or more substrate processing units each configured to process a substrate with a processing fluid;

a processing fluid supply unit configured to supply the processing fluid to the one or more substrate processing units; and a controller configured to control the processing fluid supply unit, wherein the processing fluid supply unit comprises:

a storage tank configured to store the processing fluid therein;

a heating heat exchanger configured to heat the processing fluid; and a supply path configured to supply the processing fluid to the one or more substrate processing units, and the supply path is equipped with a bypass path which bypasses the heating heat exchanger at an upstream of the one or more substrate processing units, and the processing fluid heated by the heating heat exchanger and the processing fluid supplied from the bypass path are mixed in the supply path and the mixed processing fluid is supplied to the one or more substrate processing units, wherein the processing fluid supply unit further comprises a first circulation path in which the heating heat exchanger, the supply path and a cooling heat exchanger configured to cool the processing fluid are connected with the storage tank in sequence, and the processing fluid stored in the storage tank is circulated through the first circulation path.

2. The substrate processing apparatus of claim 1, wherein the controller controls a flow rate of the processing fluid to be heated by the heating heat exchanger and a flow rate of the processing fluid to be supplied from the bypass path according to a flow rate of the processing fluid to be supplied to one or more substrate processing units, mixes the processing fluid heated by the heating heat exchanger and the processing fluid supplied from the bypass path such that the mixed processing fluid reaches a preset temperature, and supplies the mixed processing fluid of the preset temperature to the one or more substrate processing units.

3. The substrate processing apparatus of claim 1, wherein the controller stops heating by the heating heat exchanger when the supply of the processing fluid to the one or more substrate processing units is stopped.

4. The substrate processing apparatus of claim 1, wherein a second circulation path configured to circulate the processing fluid stored in the storage tank without heating the processing fluid is provided, the controller circulates the processing fluid through the first circulation path while the processing fluid is supplied to the one or more substrate processing units, whereas the controller circulates the processing fluid in the second circulation path while the processing fluid is not supplied to the one or more substrate processing units.

5. A substrate processing method using the substrate processing apparatus of claim 1, comprising:

heating the processing fluid stored in the storage tank by the heating heat exchanger and supplying the processing fluid from the supply path to the one or more substrate processing units;

supplying the processing fluid stored in the storage tank to a portion of the supply path at the upstream of the one or more substrate processing units from the bypass path which bypasses the heating heat exchanger; and mixing the processing fluid heated by the heating heat exchanger and the processing fluid supplied from the bypass path and supplying the mixed processing fluid to the one or more substrate processing units.

6. The substrate processing method of claim 5, wherein the processing fluid heated by the heating heat exchanger and the processing fluid supplied from the bypass path are mixed such that a temperature of the mixed processing fluid reaches a preset temperature by controlling a flow rate of the processing fluid to be heated by the heating heat exchanger and a flow rate of the processing fluid to be supplied from the bypass path according to a flow rate of the processing fluid to be supplied to the one or more substrate processing units, and the mixed processing fluid of the preset temperature is supplied to the one or more substrate processing units.

7. The substrate processing method of claim 5, wherein the processing fluid stored in the storage tank is circulated through a first circulation path in which the heating heat exchanger, the supply path and a cooling heat exchanger configured to cool the processing fluid are connected with the storage tank in sequence.

8. The substrate processing method of claim 5, wherein heating by the heating heat exchanger is stopped while the processing fluid is not supplied to the one or more substrate processing units.

9. The substrate processing method of claim 7, wherein the processing fluid stored in the storage tank is circulated through a second circulation path without being heated, and the processing fluid is circulated through the first circulation path while the processing fluid is supplied to the one or more substrate processing units, whereas the processing fluid is circulated through the second circulation path while the processing fluid is not supplied to the one or more substrate processing units.

* * * * *